US012680800B2

(12) United States Patent
Chen et al.

(10) Patent No.: US 12,680,800 B2
(45) Date of Patent: Jul. 14, 2026

(54) EXPLOSIVE CARTRIDGE DELIVERY TUBE

(71) Applicant: SHAN XI HUI FENG SPECIAL MOTOR VEHICLE CO., LTD., Changzhi (CN)

(72) Inventors: Feng Chen, Changzhi (CN); Junjie Cui, Changzhi (CN); Feng Liang, Changzhi (CN); Jiquan Qu, Changzhi (CN); Zhiqiang Yan, Changzhi (CN); Xuejun Ji, Changzhi (CN); Minjuan Xie, Changzhi (CN); Lianzhen Jia, Changzhi (CN); Keke Feng, Changzhi (CN); Zitao Yang, Changzhi (CN); Qiang Wang, Changzhi (CN)

(73) Assignee: SHAN XI HUI FENG SPECIAL MOTOR VEHICLE CO., LTD., Changzhi (CN)

( * ) Notice: Subject to any disclaimer, the term of this patent is extended or adjusted under 35 U.S.C. 154(b) by 3 days.

(21) Appl. No.: 19/007,517

(22) Filed: Jan. 1, 2025

(65) Prior Publication Data

US 2025/0314472 A1 Oct. 9, 2025

(30) Foreign Application Priority Data

Apr. 9, 2024 (CN) ..... 202410422289.X

(51) Int. Cl.
*F42D 1/08* (2006.01)
*E21C 37/00* (2006.01)

(52) U.S. Cl.
CPC ..... *F42D 1/08* (2013.01); *E21C 37/00* (2013.01)

(58) Field of Classification Search
CPC ..... F42D 1/08; E21C 37/00
USPC ..... 102/313
See application file for complete search history.

(56) References Cited

U.S. PATENT DOCUMENTS 1,896,817 A * 2/1933 Heitzman ..... F42D 5/06 102/304
2,171,384 A * 8/1939 Young ..... F42B 3/26 102/317
2,300,813 A * 11/1942 Savage ..... F42D 1/08 173/90
3,276,370 A * 10/1966 Foster ..... F42D 1/22 102/317
3,332,349 A * 7/1967 Schwoyer ..... F42B 3/02 102/317
3,691,954 A * 9/1972 Kern ..... F42D 1/04 102/318
3,696,703 A * 10/1972 Fox ..... F42D 1/10 86/20.15

(Continued)

FOREIGN PATENT DOCUMENTS

CN 107560504 A * 1/2018
CN 216432722 U * 5/2022

*Primary Examiner* — Samir Abdosh
(74) *Attorney, Agent, or Firm* — Siritzky Law, PLLC

(57) ABSTRACT

An explosive cartridge delivery tube is provided and includes an explosive delivery tube body, wherein the explosive delivery tube body has a length greater than a depth of a blast hole, an explosive delivery chamber is formed inside the explosive delivery tube body, the explosive delivery chamber is arranged in a length direction of the explosive delivery tube body in a running-through manner, and an internal diameter of the explosive delivery chamber is greater than a diameter of an explosive cartridge.

11 Claims, 3 Drawing Sheets

(56) References Cited

U.S. PATENT DOCUMENTS

| | | | | | |
|---|---|---|---|---|---|
| 4,085,676 | A | * | 4/1978 | Calder, Jr. | C06C 5/04<br>102/332 |
| 4,178,852 | A | * | 12/1979 | Smith | F42B 3/26<br>102/275.9 |
| 4,334,476 | A | * | 6/1982 | Day | F42B 3/26<br>102/466 |
| 4,485,741 | A | * | 12/1984 | Moore | F42B 3/26<br>102/317 |
| 4,527,482 | A | * | 7/1985 | Hynes | F42B 3/26<br>102/318 |

* cited by examiner

EXPLOSIVE CARTRIDGE DELIVERY TUBE

CROSS-REFERENCE TO RELATED APPLICATION

This application claims the priority of Chinese Patent Application No. 202410422289.X, entitled "EXPLOSIVE CARTRIDGE DELIVERY TUBE" filed with the Chinese Patent National Intellectual Property Administration on Apr. 9, 2024, which is incorporated herein by reference in its entirety.

TECHNICAL FIELD

The present disclosure relates to the field of mine blasting, and in particular to an explosive cartridge delivery tube.

BACKGROUND

In the process of mining, an explosive is often used for a blasting operation in order to ensure the efficiency of mine mining. The blasting operation is mainly to form a blast hole in an mineral deposit, charge the explosive into a gun barrel and then detonate the explosive by a detonator or a detonating cord so as to crush the mineral deposit through the work of explosion.

In the conventional related art, since the environment in a mine is extreme and hence pone to an explosion accident, high regulations are provided on the use of electrical appliances, so that traditional manual charging for blasting is still the mainstream of mine blasting.

Specifically, the explosive used in manual charging for blasting is mainly an explosive cartridge. The following steps are mainly included: S1, embedding a detonator or a detonating cord in an explosive cartridge; S2, placing the explosive cartridge for detonation in a blast hole; S3, inserting a tamping bar into the blast hole, and pushing, by means of the tamping bar, the explosive cartridge for detonation to the bottom of the blast hole; S4, withdrawing the tamping bar; S5, sequentially placing remaining explosive cartridges into the blast hole, and sequentially pushing the remaining explosive cartridges into the blast hole by means of the tamping bar; and S6, detonating the explosive cartridges for detonation, by means of a detonator wire connected to the detonator per se, or the detonating cord.

Regarding the related art mentioned above, the tamping bar needs to be inserted or withdrawn several times during charging the explosive cartridges, resulting in high work intensity of an operator.

SUMMARY

In order to reduce the work intensity of an operator in the process of mine blasting, the present disclosure provides an explosive cartridge delivery tube.

The explosive cartridge delivery tube provided by the present disclosure adopts the following technical solution:

The explosive cartridge delivery tube includes an explosive delivery tube body, wherein the explosive delivery tube body has a length greater than a depth of a blast hole, an explosive delivery chamber is formed inside the explosive delivery tube body, the explosive delivery chamber is arranged in a length direction of the explosive delivery tube body in a running-through manner, and an internal diameter of the explosive delivery chamber is greater than a diameter of an explosive cartridge.

By adopting the above technical solution, when mine blasting is carried out, the blast hole is drilled first, the explosive delivery tube body is inserted into the blast hole, and then the explosive cartridges are sequentially placed into a front end of the explosive delivery chamber. Compressed air is delivered to the explosive delivery chamber after the explosive cartridges are placed in the explosive delivery chamber, such that the explosive cartridges can be pushed to a tail end of the explosive delivery chamber by the compressed air. In the delivery of the compressed air to the explosive delivery chamber, at the same time, an operator withdraws the explosive delivery tube body from the blast hole by a distance greater than or equal to the length of the explosive cartridge, which in turn allows the explosive cartridge to slide from the tail end of the explosive delivery chamber into the blast hole under the action of the compressed air, thereby reducing the work intensity of the operator during mine blasting.

In some embodiments, an inner wall of the explosive delivery chamber is covered with a conductive film, the conductive film is grounded.

By adopting the above technical solution, during pushing the explosive cartridge to the tail end of the explosive delivery chamber, static electricity generated by friction against the inner wall of the explosive delivery chamber is conducted to the ground by the conductive film, which in turn makes the static electricity less prone to accumulate in the explosive delivery chamber, thereby ensuring the safety of the explosive cartridge.

In some embodiments, an air delivery channel is formed on an inner wall of the explosive delivery chamber, the air delivery channel extends in a length direction of the explosive delivery chamber, and an internal diameter of the air delivery channel is less than the internal diameter of the explosive delivery chamber.

In the delivery of the compressed air to the explosive delivery chamber, a certain volume of compressed air per unit of time partially continues to move along the explosive delivery chamber and partially enters the air delivery channel for continuous movement. Since the internal diameter of the air delivery channel is less than the internal diameter of the explosive delivery chamber, the pressure of the compressed air in the air delivery channel is higher than the pressure of the compressed air in the explosive delivery chamber. In this way, the explosive cartridge is less prone to rub against the inner wall of the explosive delivery chamber in the process of being pushed to the tail end of the explosive delivery chamber, which not only ensures smooth delivery of the explosive cartridge but also reduces frictional static electricity, such that the explosive cartridge can be charged fast and safely.

In some embodiments, multiple air delivery channels are provided, the multiple air delivery channels are uniformly distributed circumferentially around an axis of the explosive delivery chamber.

By adopting the above technical solution, the multiple air delivery channels distributed circumferentially around the axis of the explosive delivery chamber make the explosive cartridge less prone to come into contact with the inner wall of the explosive delivery chamber for long time in the process of being pushed to the tail end of the explosive delivery chamber, thereby further reducing the generation of static electricity.

In some embodiments, an outer surface of the explosive delivery tube body is smooth, and the explosive delivery tube body is elastic.

By adopting the above technical solution, the explosive delivery tube body having the smooth outer surface is less prone to sag or bulge, such that the explosive delivery tube body can be inserted into the blast hole more smoothly. In addition, the elastic explosive delivery tube body of which the length is greater than the depth of the blast hole can be smoothly inserted into or withdrawn from the blast hole in a narrow-space mine through elastic deformation, which is more convenient for a blasting operation in the mine.

In some embodiments, the explosive delivery tube body is made of plastic.

By adopting the above technical solution, plastic is low in cost, favorable in weather resistance and light in weight, and thus is not only easier to replace after being damaged but also more convenient for the operator to carry than an elastic metal in the mine with a harsh environment.

In some embodiments, a wire slot is formed on an outer surface of the explosive delivery tube body, the wire slot is configured to receive a detonator wire or a detonating cord, the wire slot is located at an end portion of the explosive delivery tube body, and the wire slot is in communication with the explosive delivery chamber.

By adopting the above technical solution, during charging the explosive cartridge, the detonator wire connected to the detonator per se or the detonating cord passes through the wire slot and is guided out of the blast hole, such that the explosive delivery tube body is less prone to press the detonator wire or the detonating cord in the process of being inserted into the blast hole, thereby reducing the incidence of damage to the detonator wire or the detonating cord.

In some embodiments, a pneumatic withdrawal assembly is further included, the pneumatic withdrawal assembly is configured for pneumatically driving the explosive delivery tube body to withdraw from the blast hole.

By adopting the above technical solution, the explosive delivery tube body is pneumatically driven to withdraw from the blast hole, which is less dependent on electricity and is safer. Moreover, the movement is carried out in the same way as that of delivering the explosive cartridge by the explosive delivery tube body, which also reduces the complexity of a blasting operation apparatus.

In some embodiments, the pneumatic withdrawal assembly includes a reaction force base plate, a withdrawal cylinder and an explosive delivery tube fixing member, one end of the withdrawal cylinder being mounted on the reaction force base plate, and the explosive delivery tube fixing member being configured to fix and mount the explosive delivery tube body at the other end of the withdrawal cylinder.

By adopting the above technical solution, the withdrawal cylinder responds quickly, and thus after introduction of air, can quickly drive the explosive delivery tube body to withdraw from the blast hole, which reduces the incidence of the explosive delivery tube body preventing the explosive cartridge from falling into the blast hole.

In some embodiments, a movable plate is mounted at one end of the withdrawal cylinder, the explosive delivery tube fixing member includes a first fixing block and a second fixing block, the first fixing block is in sliding fit with one side of the movable plate, and the first fixing block is provided with a first fixing hole; and the second fixing block is in sliding fit with the other side of the movable plate, the second fixing block is provided with a second fixing hole, the second fixing block is detachably mounted on the first fixing block, and the second fixing hole is in communication with the first fixing hole to form an explosive delivery tube fixing hole when the second fixing block is mounted on the first fixing block.

By adopting the above technical solution, the explosive delivery tube body needs to gradually withdraw from the blast hole when the explosive cartridges are charged sequentially. The explosive delivery tube body is held and fixed by the explosive delivery tube fixing hole formed by the first fixing block and the second fixing block, such that the explosive delivery tube body can be easily and efficiently fixed during its gradual withdrawal.

In summary, the present disclosure includes at least one of the following beneficial technical effects.

1. When mine blasting is carried out, the blast hole is drilled first, the explosive delivery tube body is inserted into the blast hole, and then the explosive cartridges are sequentially placed into the front end of the explosive delivery chamber. Compressed air is delivered to the explosive delivery chamber after the explosive cartridges are placed in the explosive delivery chamber, such that the explosive cartridges can be pushed to the tail end of the explosive delivery chamber by the compressed air. In the delivery of the compressed air to the explosive delivery chamber, at the same time, an operator withdraws the explosive delivery tube body from the blast hole by a distance greater than or equal to the length of the explosive cartridge, which in turn allows the explosive cartridge to slide from the tail end of the explosive delivery chamber into the blast hole under the action of the compressed air, thereby reducing the work intensity of the operator during mine blasting.

2. During pushing the explosive cartridge to the tail end of the explosive delivery chamber, static electricity generated by friction against the inner wall of the explosive delivery chamber is conducted to the ground by the conductive film, which in turn makes the static electricity less prone to accumulate in the explosive delivery chamber, thereby ensuring the safety of the explosive cartridge.

3. The explosive delivery tube body is pneumatically driven to withdraw from the blast hole, which is less dependent on electricity and is safer. Moreover, the movement is carried out in the same way as that of delivering the explosive cartridge by the explosive delivery tube body, which also reduces the complexity of the blasting operation apparatus.

List of reference signs: 1. Explosive delivery tube body; 101. Explosive delivery chamber; 102. Wire slot; 103. Air delivery channel; 11. Conductive film; 2. Pneumatic withdrawal assembly; 201. Explosive delivery tube fixing hole; 21. Reaction force base plate; 22. Withdrawal cylinder; 221.

Movable plate; 23. First fixing block; 231. First slide bar; 232. First rubber pad; 24. Second fixing block; 241. Second slide bar; 242. Second rubber pad; 3. Connecting end cap; 31. Nozzle joint; 32. Grounded pole piece; 4. Explosive delivery valve; 5. Air compressor.

DETAILED DESCRIPTION OF THE EMBODIMENTS

The present disclosure will be further described in detail with reference to FIGS. 1-5.

Embodiment 1

Figure 1:
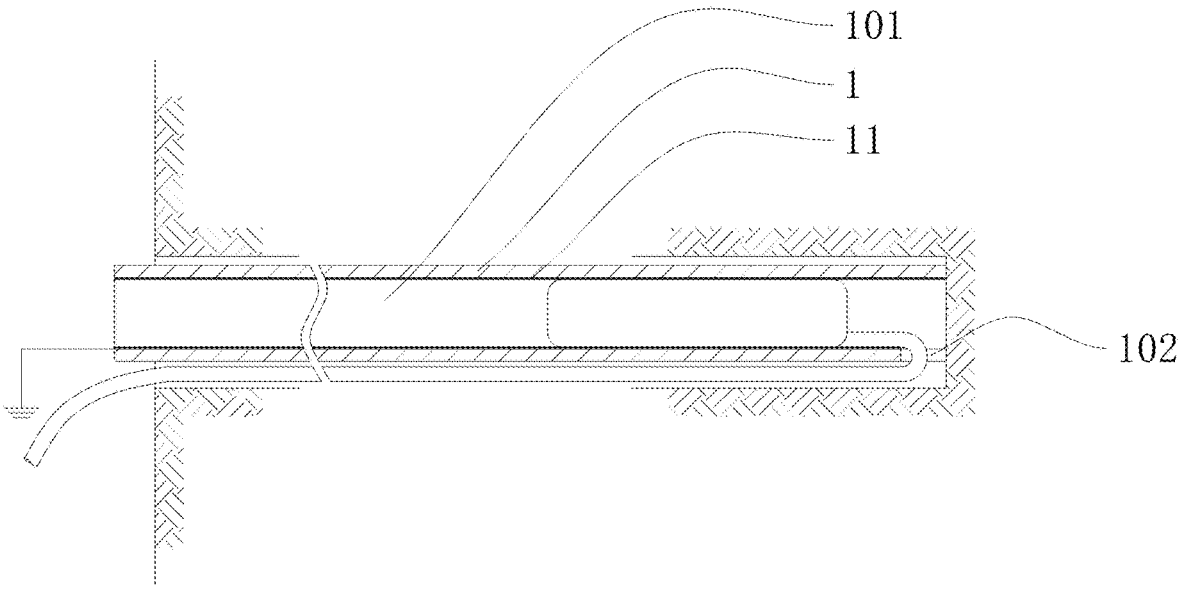
FIG. 1 is a schematic diagram of implementation of an explosive delivery tube body according to Embodiment 1 of the present disclosure.

The embodiment of the present disclosure discloses an explosive cartridge delivery tube. Referring to FIG. 1, the explosive cartridge delivery tube includes an explosive delivery tube body 1, the length of the explosive delivery tube body 1 is greater than the depth of a blast hole, and the external diameter of the explosive delivery tube body 1 is less than the internal diameter of the blast hole. The outer surface of the explosive delivery tube body 1 is smooth, and the explosive delivery tube body 1 is elastic and is made of plastic. Specifically, in Embodiment 1 of the present disclosure, the specific material of the explosive delivery tube body 1 is polyethylene (PE) in order to take into account of both the elasticity and the weight of the explosive delivery tube body 1, making it easier to transport the explosive delivery tube body 1 in a narrow-space mine.

Referring to FIG. 1, an explosive delivery chamber 101 is formed inside the explosive delivery tube body 1, the explosive delivery chamber 101 is arranged in the length direction of the explosive delivery tube body 1 in a running-through manner, and the internal diameter of the explosive delivery chamber 101 is greater than the diameter of an explosive cartridge. In Embodiment 1 of the present disclosure, the explosive delivery chamber 101 has one end provided as a front end of the explosive delivery chamber 101 and the other end provided as a tail end of the explosive delivery chamber 101. The explosive delivery tube body 1 is provided the outer surface thereof with a wire slot 102 for receiving a detonator wire or a detonating cord, the wire slot 102 is located at the tail end of the explosive delivery tube body 1, and the wire slot 102 is in communication with the explosive delivery chamber 101, such that the explosive delivery tube body 1 is less prone to press the detonator wire or the detonating cord during inserting the explosive delivery tube body 1 into the blast hole, thereby reducing the incidence of damage to the detonator wire or the detonating cord.

Figure 2:
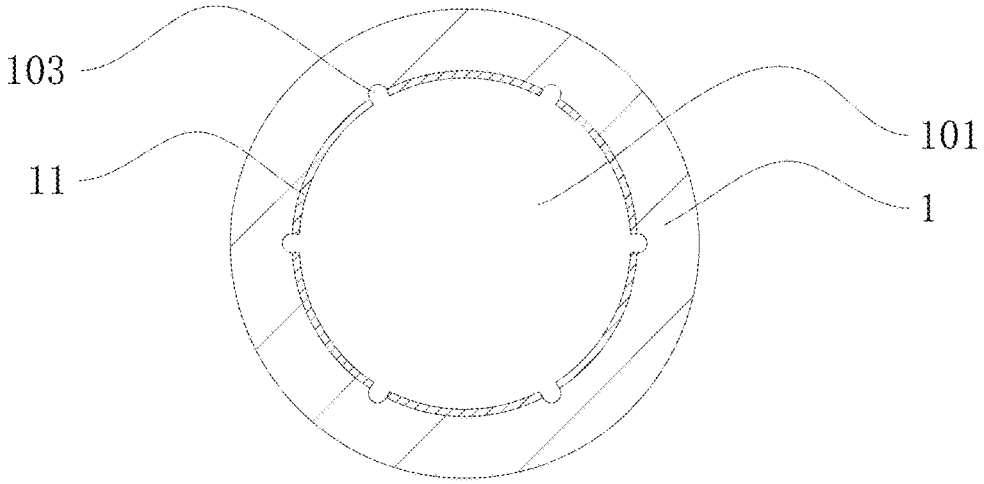
FIG. 2 is a cross-section view of the explosive delivery tube body according to Embodiment 1 of the present disclosure.

Referring to FIGS. 1 and 2, the inner wall of the explosive delivery chamber 101 is provided with multiple air delivery channels 103, and the multiple air delivery channels 103 are uniformly distributed circumferentially around the axis of the explosive delivery chamber 101. Each air delivery channel 103 extends in the length direction of the explosive delivery chamber 101, and the internal diameter of the air delivery channel 103 is less than the internal diameter of the explosive delivery chamber 101, such that a radial thrust can be formed on the explosive cartridge by increasing air with a higher pressure in the air delivery channel 103 after introduction of the compressed air, thereby making the explosive cartridge less prone to come into contact with the inner wall of the explosive delivery chamber 101 for long time.

Referring to FIGS. 1 and 2, the inner wall of the explosive delivery chamber 101 is covered with multiple conductive films 11, and the multiple conductive films 11 are uniformly distributed circumferentially around the axis of the explosive delivery chamber 101. The conductive films 11 are located between two adjacent air delivery channels 103, and extend in the length direction of the explosive delivery chamber 101 to two ends of the explosive delivery chamber 101. The conductive films 11 are grounded, i.e., the conductive films 11 are electrically connected to the ground, such that the frictional static electricity generated during the delivery of the explosive cartridge can be conducted to the ground, thereby reducing the static electricity accumulated in the explosive delivery chamber 101.

The implementation principle of the explosive cartridge delivery tube according to Embodiment 1 of the present disclosure is as follows:

S1, a blast hole is formed;

S2, the detonator or the detonating cord is embedded in the explosive cartridge for detonation;

S3, the explosive cartridge embedded with the detonator or the detonating cord is placed at the tail end of the explosive delivery chamber 101, i.e., the end of the explosive delivery tube body 1 provided with the wire slot 102, and then a detonator wire or the detonating cord passes through the wire slot 102;

S4, the tail end of the explosive delivery tube body 1 is inserted into the blast hole, and the detonator wire or the detonating cord is guided out of the blast hole during the insertion;

S5, the front end of the explosive delivery chamber 101, i.e., the end of the explosive delivery tube body 1 away from the wire slot 102, is in communication with an air compressor or other compressed air generating devices;

S6, the compressed air is delivered to the explosive delivery chamber 101 by the air compressor or other compressed air generating devices, and during the delivery of the compressed air, the explosive delivery tube body 1 is withdrew from the blast hole by a length greater than or equal to the length of the explosive cartridge until the explosive cartridge slides from the tail end of the explosive delivery chamber 101 to the bottom of the blast hole;

S7, another explosive cartridge is placed at the front end of the explosive delivery chamber 101;

S8, the compressed air is delivered to the explosive delivery chamber 101 by the air compressor or other compressed air generating devices, and during the delivery of the compressed air, the explosive delivery tube body 1 is withdrew from the blast hole by a length greater than or equal to the length of the explosive cartridge until the explosive cartridge slides from the tail end of the explosive delivery chamber 101 to the bottom of the blast hole;

S9, S7 and S8 are repeated until all remaining explosive cartridges are delivered into the blast hole; and S10, the explosive delivery tube body 1 is completely withdrew from the blast hole.

By the above implementation mode, the explosive cartridges are pushed into the blast hole using the compressed air, such that an operator does not need to insert or withdraw a gun roller several times, thereby reducing the work intensity of the operator in the process of mine blasting.

Embodiment 2

The main differences between the present disclosure and Embodiment 1 are as follows:

1. the explosive cartridge delivery tube further includes a pneumatic withdrawal assembly 2; and
2. the front end of the explosive delivery tube body 1 is specifically set differently.

Difference 1 of Embodiment 2

Figure 3:
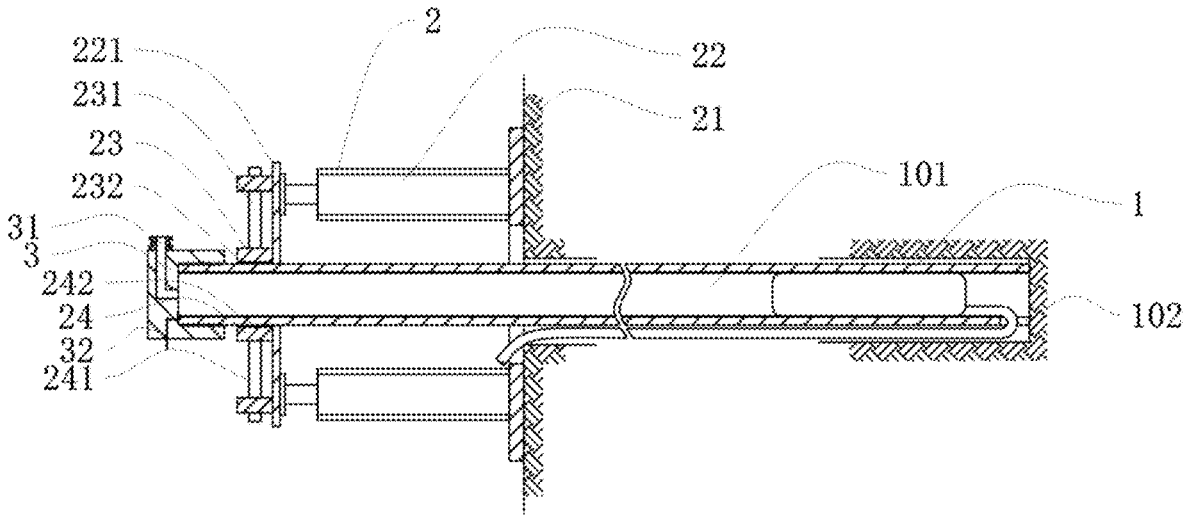
FIG. 3 is a schematic diagram of implementation of an explosive cartridge delivery tube according to Embodiment 2 of the present disclosure.

Referring to FIG. 3, the pneumatic withdrawal assembly 2 is located at the front end of the explosive delivery tube body 1. The pneumatic withdrawal assembly 2 includes a reaction force base plate 21, a withdrawal cylinder 22 and an explosive delivery tube fixing member. The reaction force base plate 21 is provided with a first through hole in its thickness direction in a running-through manner, and the front end of the explosive delivery tube body 1 slides through the first through hole when the explosive cartridge is delivered into the blast hole. A cylinder body of the withdrawal cylinder 22 is fixedly mounted on one side of the reaction force base plate 21, and a piston rod of the withdrawal cylinder 22 is arranged in the length direction of the explosive delivery tube body 1 when the explosive cartridge is delivered into the blast hole.

Referring to FIG. 3, the piston rod of the withdrawal cylinder 22 is fixedly mounted to a movable plate 221, the movable plate 221 is provided with a second through hole in its thickness direction in a running-through manner, and the front end of the explosive delivery tube body 1 slides through the second through hole when the explosive cartridge is delivered into the blast hole.

Figure 4:
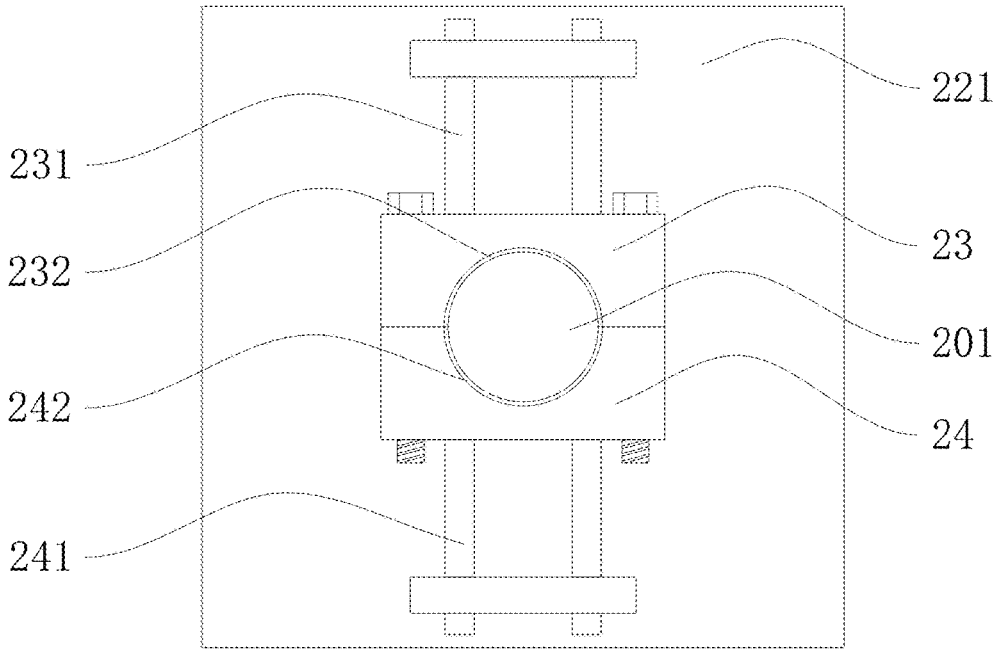
FIG. 4 is an overall schematic diagram of an explosive delivery tube fixing member according to Embodiment 2 of the present disclosure.

Referring to FIGS. 3 and 4, the explosive delivery tube fixing member includes a first fixing block 23 and a second fixing block 24, the first fixing block 23 is in sliding fit with one side of the movable plate 221 by a first slide bar 231, the second fixing block 24 is in sliding fit with the other side of a sliding plate by a second slide bar 241, and the first fixing block 23 and the second fixing block 24 are arranged right opposite to each other.

Referring to FIG. 4, the second fixing block 24 is detachably mounted on the second fixing block 24 by a fixing bolt, a side of the first fixing block 23 right opposite to the second fixing block 24 is provided with a first fixing hole, and a side of the second fixing block 24 right opposite to the first fixing block 23 is provided with a second fixing hole. When the second fixing block 24 is mounted on the first fixing block 23, the second fixing hole is in communication with the first fixing hole to form an explosive delivery tube fixing hole 201, and the internal diameter of the explosive delivery tube fixing hole 201 is less than or equal to the diameter of the explosive delivery tube body 1, such that the explosive delivery tube body 1 can be held and fixed by the first fixing block 23 and the second fixing block 24.

Referring to FIG. 4, the inner wall of the first fixing hole is fixedly covered with a first rubber pad 232, and the inner wall of the second fixing hole is fixedly covered with a second rubber pad 242, such that the explosive delivery tube body 1 can be held and fixed by the first fixing block 23 and the second fixing block 24, and the friction of the first fixing block 23 and the second fixing block 24 against the explosive delivery tube body 1 can be increased by means of the first rubber pad 232 and the second rubber pad 242, thereby allowing the explosive delivery tube body 1 to withdraw from the blast hole under the pneumatic action of the withdrawal cylinder 22.

Difference 2 of Embodiment 2

Figure 5:
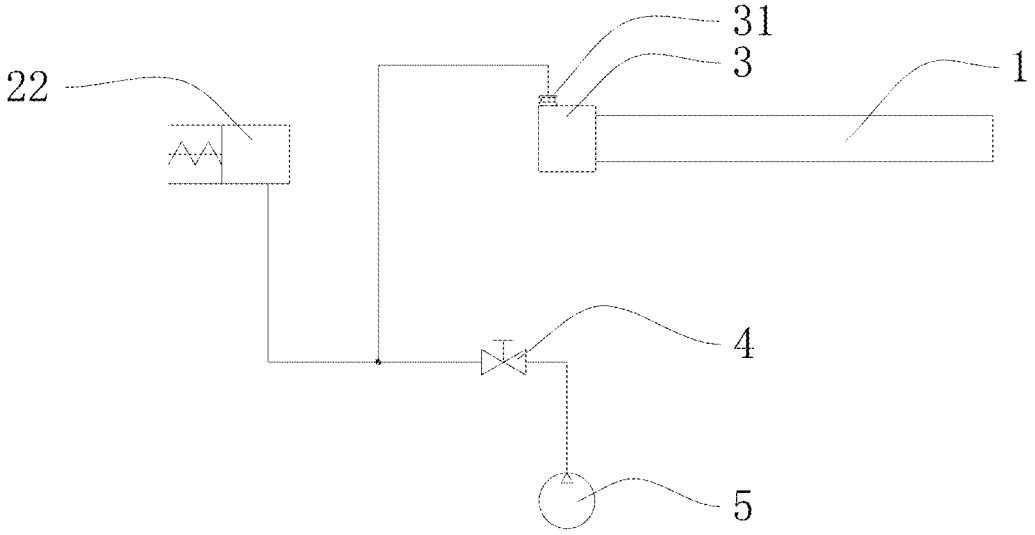
FIG. 5 is a schematic PID (Piping and Instruments Diagram) diagram of the explosive cartridge delivery tube according to Embodiment 2 of the present disclosure.

Referring to FIG. 3, the front end of the explosive delivery tube body 1 is provided with a connecting end cap 3, the connecting end cap 3 is in threaded fit with the front end of the explosive delivery tube body 1, and the connecting end cap 3 closes the explosive delivery chamber 101. The explosive delivery chamber 101 is fixedly mounted to a nozzle joint 31, and the nozzle joint 31 is in communication with the explosive delivery chamber 101, such that compressed air can be delivered to the explosive delivery chamber 101 through the nozzle joint 31. Referring to FIG. 5, the withdrawal cylinder 22 and the nozzle joint 31 are in communication with an air compressor 5 through an explosive delivery valve 4. Specifically, both the withdrawal cylinder 22 and the nozzle joint 31 are connected to an output end of the explosive delivery valve 4, and an input end of the explosive delivery valve 4 is connected to the air compressor 5, such that the compressed air can be delivered to the withdrawal cylinder 22 and a nozzle head simultaneously through the air compressor 5.

Referring to FIG. 3, the connecting end cap 3 is mounted to a grounded pole piece 32, one end of the grounded pole piece 32 is in close fit with the conductive film 11, and the other end of the grounded pole piece 32 is electrically connected to the ground, such that the conductive film 11 can be electrically connected to the ground by the grounded pole piece 32.

The implementation principle of Embodiment 2 of the present disclosure is as follows:

S1, a blast hole is formed;

S2, the detonator or the detonating cord is embedded in the explosive cartridge for detonation;

S3, the explosive cartridge embedded with the detonator or the detonating cord is placed at the tail end of the explosive delivery chamber 101, i.e., the end of the explosive delivery tube body 1 provided with the wire slot 102, and then a detonator wire or the detonating cord passes through the wire slot 102;

S4, the tail end of the explosive delivery tube body 1 is inserted into the blast hole, and the detonator wire or the detonating cord is guided out of the blast hole during the insertion;

S5, the front end of the explosive delivery chamber 101, i.e., the end of the explosive delivery tube body 1 away from the wire slot 102, passes through the first through hole of the reaction force base plate 21 and the second through hole of the movable plate 221, and the reaction force base plate 21 is in close fit with an mineral deposit;

S6, the connecting end cap 3 is in threaded fit with the front end of the explosive delivery tube body 1, and the grounded pole piece 32 is in close fit with the conductive film 11;

S7, the input end of the explosive delivery valve 4 is connected to the air compressor 5, then the explosive delivery valve 4 is opened until the explosive cartridge slides from the tail end of the explosive delivery chamber 101 to the bottom of the blast hole, and subsequently, the explosive delivery valve 4 is closed; specifically, the piston rod of the withdrawal cylinder 22 extends after the explosive delivery valve 4 is opened, such that the reaction force base plate 21 is in close fit with the mineral deposit, which in turn the piston rod of the withdrawal cylinder 22 drives the explosive delivery tube body 1 away from the blast hole;

S8, the connecting end cap 3 is detached from the front end of the explosive delivery tube body 1 by turning the connecting end cap 3;

S9, another explosive cartridge is placed at the front end of the explosive delivery chamber 101;

S10, the connecting end cap 3 is in threaded fit with the front end of the explosive delivery tube body 1, and the grounded pole piece 32 is in close fit with the conductive film 11;

S11, the input end of the explosive delivery valve 4 is connected to the air compressor 5, then the explosive delivery valve 4 is opened until the explosive cartridge slides from the tail end of the explosive delivery chamber 101 to the bottom of the blast hole, and subsequently, the explosive delivery valve 4 is closed;

S12, S8 and S11 are repeated until all remaining explosive cartridges are delivered into the blast hole; and S13, the explosive delivery tube body 1 is completely withdrew from the blast hole, and the pneumatic withdrawal assembly 2 is withdrew from the mineral deposit.

By the above implementation mode, the explosive cartridges are pushed into the blast hole using the compressed air, and the explosive delivery tube body 1 is pneumatically withdrawn from the blast hole by means of the withdrawal cylinder 22, such that the operator neither needs to insert or withdraw a gun roller several times nor needs to manually withdraw the explosive delivery tube 1, thereby reducing the work intensity of the operator in the process of mine blasting.

The above are preferred embodiments of the present disclosure, and are not intended to limit the scope of protection of the present disclosure accordingly. Therefore, all equivalent changes made in accordance with the structure, shape and principle of the present disclosure shall be included in the scope of protection of the present disclosure.

What is claimed is:

1. An explosive cartridge delivery tube comprising an explosive delivery tube body, wherein the explosive delivery tube body has a length greater than a depth of a blast hole, an explosive delivery chamber is formed inside the explosive delivery tube body and arranged in a length direction of the explosive delivery tube body in a running-through manner, and an internal diameter of the explosive delivery chamber is greater than a diameter of an explosive cartridge, wherein an inner wall of the explosive delivery chamber is covered with a conductive film being grounded.

2. The explosive cartridge delivery tube according to claim 1, wherein an air delivery channel is formed on an inner wall of the explosive delivery chamber and extends in a length direction of the explosive delivery chamber, and an internal diameter of the air delivery channel is less than the internal diameter of the explosive delivery chamber.

3. The explosive cartridge delivery tube according to claim 2, wherein the air delivery channel comprises a plurality of air delivery channels uniformly distributed circumferentially around an axis of the explosive delivery chamber.

4. The explosive cartridge delivery tube according to claim 1, wherein an outer surface of the explosive delivery tube body is smooth, and the explosive delivery tube body is elastic.

5. The explosive cartridge delivery tube according to claim 4, wherein the explosive delivery tube body is made of plastic.

6. The explosive cartridge delivery tube according to claim 1, wherein a wire slot is formed on an outer surface of the explosive delivery tube body, configured to receive a detonator wire or a detonating cord, located at an end of the explosive delivery tube body, and in communication with the explosive delivery chamber.

7. The explosive cartridge delivery tube according to claim 1, further comprising a pneumatic withdrawal assembly configured for pneumatically driving the explosive delivery tube body to withdraw from the blast hole.

8. The explosive cartridge delivery tube according to claim 7, wherein the pneumatic withdrawal assembly comprises a reaction force base plate, a withdrawal cylinder and an explosive delivery tube fixing member, one end of the withdrawal cylinder is mounted on the reaction force base plate, and the explosive delivery tube fixing member is configured to fix and mount the explosive delivery tube body at an other end of the withdrawal cylinder.

9. The explosive cartridge delivery tube according to claim 8, wherein a movable plate is mounted at one end of the withdrawal cylinder, the explosive delivery tube fixing member comprises a first fixing block and a second fixing block, the first fixing block is in sliding fit with one side of the movable plate and provided with a first fixing hole; and the second fixing block is in sliding fit with the other side of the movable plate, provided with a second fixing hole, detachably mounted on the first fixing block, and in communication with the first fixing hole to form an explosive delivery tube fixing hole when the second fixing block is mounted on the first fixing block.

10. An explosive cartridge delivery tube comprising an explosive delivery tube body, wherein the explosive delivery tube body has a length greater than a depth of a blast hole, an explosive delivery chamber is formed inside the explosive delivery tube body and arranged in a length direction of the explosive delivery tube body in a running-through manner, and an internal diameter of the explosive delivery chamber is greater than a diameter of an explosive cartridge, wherein an air delivery channel is formed on an inner wall of the explosive delivery chamber and extends in a length direction of the explosive delivery chamber, and an internal diameter of the air delivery channel is less than the internal diameter of the explosive delivery chamber.

11. An explosive cartridge delivery tube comprising an explosive delivery tube body, wherein the explosive delivery tube body has a length greater than a depth of a blast hole, an explosive delivery chamber is formed inside the explosive delivery tube body and arranged in a length direction of the explosive delivery tube body in a running-through manner, and an internal diameter of the explosive delivery chamber is greater than a diameter of an explosive cartridge, wherein the air delivery channel comprises a plurality of air delivery channels uniformly distributed circumferentially around an axis of the explosive delivery chamber.

* * * * *